United States Patent [19]

Merrel

[11] Patent Number: 4,468,897

[45] Date of Patent: Sep. 4, 1984

[54] UNIVERSAL PNEUMATIC GRINDING BAR

[75] Inventor: Richard C. Merrel, Lakewood, Calif.

[73] Assignees: Joseph V. Munoz, El Toro; Anthony J. Zavala, Long Beach, both of Calif. ; part interest to each

[21] Appl. No.: 424,384

[22] Filed: Sep. 27, 1982

[51] Int. Cl.[3] ..... B24B 41/00

[52] U.S. Cl. ..... 51/259; 29/28; 29/57; 51/134.5 F

[58] Field of Search ..... 51/259, 260, 261, 134.5 F, 51/241 R, 50 H; 409/240; 29/57, 28; 408/130

[56] References Cited

U.S. PATENT DOCUMENTS

| | | | |
|---|---|---|---|
| 691,740 | 1/1902 | Birkenstock | 51/170 T |
| 833,710 | 10/1906 | Fletcher | 51/259 |
| 1,236,604 | 8/1917 | Rhinevault | 51/260 |
| 1,304,278 | 5/1919 | Dessez | 51/134.5 F |
| 1,970,645 | 8/1934 | Blood | 51/50 H |
| 2,257,619 | 9/1941 | Prill | 51/134.5 F |
| 2,400,912 | 5/1946 | Britt et al. | 51/134.5 F |
| 2,545,453 | 3/1951 | Forss | 51/134.5 F |
| 2,614,372 | 10/1952 | Kelly | 51/241 A |
| 3,383,805 | 5/1968 | Powell | 51/134.5 F |
| 3,641,710 | 2/1972 | Heinelt | 51/134.5 F |
| 3,827,834 | 8/1974 | Kakimoto | 51/134.5 F |
| 3,885,355 | 5/1975 | Kakimoto | 51/170 T |
| 4,141,671 | 2/1979 | Tarsoly | 51/134.5 F |

FOREIGN PATENT DOCUMENTS

| | | | |
|---|---|---|---|
| 417014 | 12/1946 | Italy | 51/134.5 F |

*Primary Examiner*—Roscoe V. Parker

*Attorney, Agent, or Firm*—Fulwider, Patton, Rieber, Lee & Utecht

[57] ABSTRACT

A universal grinding bar adapted to be connected to a standardized, quick-change tool holder can be devised for use with conventional engine lathes, milling machines and the like and used as a standardized tool without the limitations of direct coupling to the drive of the engine lathe or milling machine. The universal grinding bar includes a modular delivery tube of selected shape and length and a modular turbine housing connected to the delivery tube and including a selected one of a plurality of pneumatic motors characterized by different operating speeds. Pressurized air is coupled through the end of the delivery tube distal from the turbine housing and is delivered to the pneumatic motor through a pressure tube. The spent air is then returned through a metering plate between the turbine housing delivery tube through an internal bore within the delivery tube to exhaust ports at the distal end. The delivery tube is of such diameter to allow connection to a conventional quick-change tool holder. By appropriate selection of the pneumatic motor and length and shape of the delivery tube, a grinding tool driven by the pneumatic motor can be arbitrarily positioned and oriented with respect to a workpiece without the need for special drives or attachments.

11 Claims, 8 Drawing Figures

UNIVERSAL PNEUMATIC GRINDING BAR

BACKGROUND OF THE INVENTION

1. Field of the Invention

The present invention relates to apparatus for driving tools and in particular relates to pneumatically driven tools for use in combination with other machine tools.

2. Description of the Prior Art

Many machine tool applications, particularly production applications, require a variety of special tooling packages specifically designed for one type of application. Often this requires production of custom tooling to suit a specific customer's needs. For example, pneumatic valve grinders such as shown by Kelly, "Valve Grinder", U.S. Pat. No. 2,614,372, or pneumatic crank pin grinders such as shown by Prill, "Crank Pin Grinder", U.S. Pat. No. 2,257,619, typify apparatus which are not only specifically designed for a particular type of grinding or tooling application, but are also customized to a specific model valve seat or crank pin.

Other pneumatic grinders are also well known in the art where the grinder serves as a fixed machine head or as a general-purpose hand-held tool, such as used for polishing as shown by Birkenstock, "Pneumatic Polishing Tool", U.S. Pat. No. 691,740, Kakimoto, "Pneumatically Driven Grinder", U.S. Pat. No. 3,885,335, or Kakimoto, "Small Diameter Cylindrical Air Motor for Driving Grinders and the Like", U.S. Pat. No. 3,827,834. However, when applied in combination with standard lathes or milling machines, such independently driven grinding apparatus have typically been mechanically powered by gear trains or belts and pulleys by the same machinery used to power the lathe. An example of this prior art practice is shown by Blood, "Grinding Machine", U.S. Pat. No. 1,970,645, and by Fletcher, "Pneumatic Tool", U.S. Pat. No. 833,710.

Even in those cases where a pneumatically driven tool is combined with a standard engine lathe its use has been limited and restricted by the limitations imposed upon the tooling by the fixed mechanical coupling, usually through a drive shaft, between the pneumatic motor and the grinding wheel, see, for example, Rhinevault, "Grinding Machine", U.S. Pat. No. 1,236,604.

What is needed is some means of configuring a pneumatically driven tool so that it can be treated as a universal tool used in combination with standardized, quick-change tool holders in conventional milling machines or lathes. In addition, some means is needed to conveniently select both the position and the orientation of the pneumatically driven tool with respect to the workpiece without having a customized tool for each position or oeientation. In addition, a means is needed whereby the operating speed of the grinding wheel coupled to the pneumatically driven motor wheel can be varied or changed, again without having a completely separate tool for each application.

These and other objects of the present invention can be best understood by considering the following brief summary of the invention.

BRIEF SUMMARY OF THE INVENTION

The present invention is an improvment in a pneumatic drive for a tool such as a grinder used in combination with conventional engine lathes, milling machines and the like, and is particularly adapted for coupling to a conventional quick-change tool holder. The improvement comprises a pneumatic motor included within a modular turbine housing including a drive shaft extending from the pneumatic motor for engagement with the tool or grinding wheel. A modular delivery tube is connected to the turbine housing and supports the turbine housing in the predetermined orientation and position. The delivery tube also includes an internal tube for delivering pressurized air to the pneumatic motor. By reason of this combination of elements, the tool may be pneumatically driven in an arbitrary position and orientation by appropriate selection of the shape and length of the modular delivery tube connected to the turbine housing, thereby allowing the pneumatically driven tool or grinder to be easily adapted for use with standardized production machinery. The delivery tube is arranged and configured at its end, distal from the turbine housing, for connection with the quick-change tool holder so that the pneumatic drive of the present invention is as quickly interchangeable with the quick-change tool holder as a standardized tool. In addition, the delivery tube is interchangeable with a plurality of pneumatic motors which are included within a corresponding turbine housing connected to the delivery tube so that pneumatic motors characterized by different operating speeds can be selectively coupled to the delivery tube for each application.

These and other embodiments of the present invention can best be understood by viewing the following Figures in light of the Detailed Description of the Preferred Embodiments.

DETAILED DESCRIPTION OF THE PREFERRED EMBODIMENTS

The present invention is an improved universal pneumatic grinding bar which can be coupled to standardized quick-change, tool holders and used in combination with conventional lathe and milling machines. The length of the grinding bar, as well as the shape, may be changed by combining interchangeable parts which constitute the grinding bar, as described in greater detail below. The pneumatic motor used in combination with the grinding bar may also be easily changed to effect various operating speeds.

Figure 1:
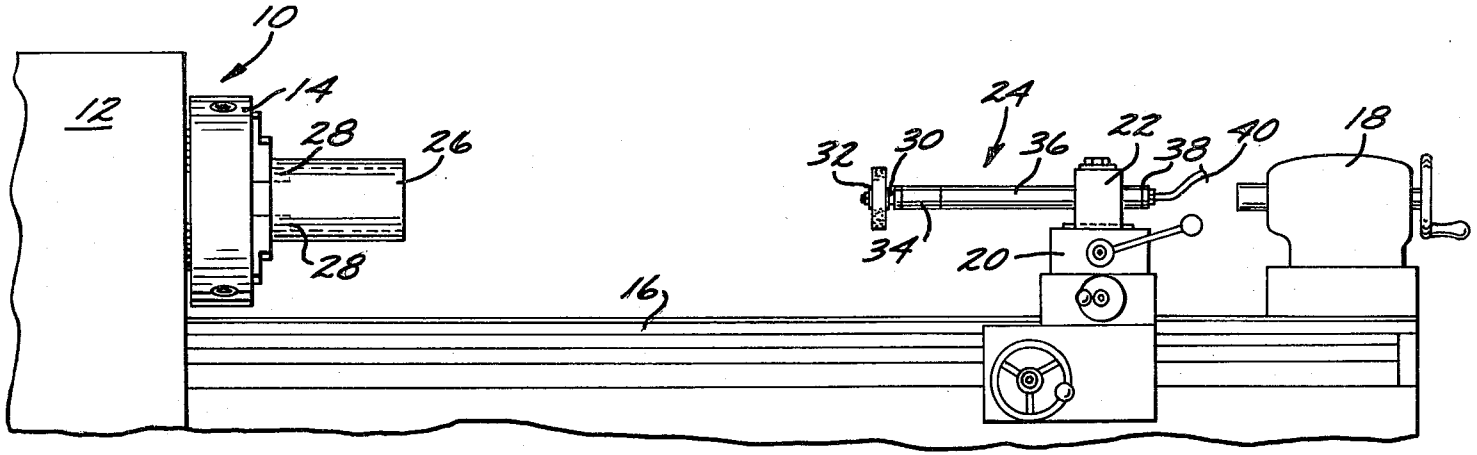
FIG. 1 is a fragmentary side elevational view showing the principal operable portion of a standard engine lathe having a quick-change tool holder coupled to a grinding bar devised according to the present invention.

Referring now to FIG. 1, a standard lathe 10 is generally denoted by a reference character 10 and includes a spindle housing 12 coupled to a conventional three jaw chuck 14. Bed 16 of lathe 10 provides the support base for a conventional tail stock 18 and carriage 20. In the application illustrated in FIG. 1 carriage 20 provides a means for mounting a standardized, quick-change tool holder 22 generally used as a universal tool post. The grinding bar of the present invention, generally denoted by reference number 24, is clamped into tool holder 22 in a conventional manner and centered with respect to workpiece 26. In the illustrated embodiment, workpiece 26 is a boiler tube in which hard sediments 28 have accumulated. Tube 26 has been removed from the boiler and placed within engine lathe 10 for internal grinding by grinding bar 24.

Grinding bar 24 includes a grinding wheel or tool 32, turbine housing 34 and delivery tube 36. Drive shaft 30, a segment of which is shown in FIG. 1, is coupled to conventional grinding wheel 32 which is used to ream sediment 28 from pipe 26. Grinding wheel 32 is driven by shaft 30 by a pneumatic motor shown and described in greater detail in connection with FIGS. 3 and 4 which motor is included within turbine housing 34. Turbine housing 34 in turn is connected to delivery tube 36 which is directly mounted in quick-change tool holder 22. The end of delivery tube 36 is provided with an end cap 38 which includes a fitting for high pressure air hose 40. Air pressure is delivered from a conventional air source (not shown) through house 40 via delivery tube 36 to the pneumatic motor contained within turbine housing 34 to drive grinding wheel 32.

As will be discussed below, various types of pneumatic motors included with turbine housing 34 may be combined with any given delivery tube 36, and similarly a plurality of different shapes and lengths of delivery tubes 36 may be combined with any given turbine housing 34 to arbitrarily orient and position grinding wheel 32 with respect to workpiece 26.

Figure 2:
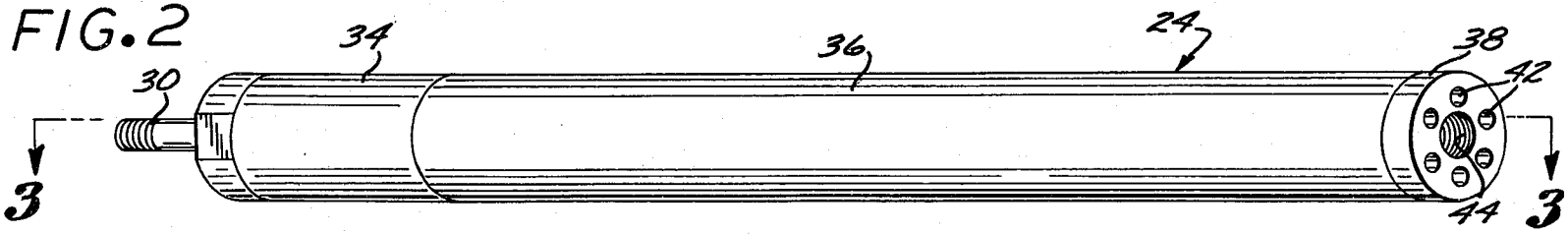
FIG. 2 is a perspective view in enlarged scale of the grinding bar shown in FIG. 1.

Referring now to FIG. 2, a perspective view of grinding bar 24 is shown in enlarged scale which more clearly illustrates the basic components of grinding bar 24. Grinding bar 24 is modular in construction, as described above. A plurality of pneumatic motors insertable in turbine housing 34 can be combined with differently shaped delivery tubes 36 of different lengths to obtain a grinding bar having the operating speed and configuration desired for any given application.

In the illustration of FIG. 2, drive shaft 30 is clearly shown wth grinding wheel 32 removed. In the preferred embodiment, turbine housing 34 and delivery tube 36 each have a generally cylindrical, elongated outer configuration of substantially equal diameter. Delivery tube 36 can be conveniently clamped within a corresponding cylindrical bore (not shown) within standardized quick-change tool holder 22 shown in FIG. 1.

FIG. 2 also illustrates in greater detail the configuration of stationary end cap 38 when cap 38 is disconnected from house 40. End cap 38 is connected to that end of delivery tube 36 distal from turbine housing 34 and includes a plurality of exhaust ports 42 circumferentially defined about an axial inlet port 44. Hose 40 couples to inlet port 44 through a threaded nipple and provides high pressure air through inlet port 44 to the pneumatic motor described in greater detail in FIG. 3. The exhaust air, once having expended its energy in the pneumatic motor, is then returned through a bore defined in delivery tube 36, again better described in connection with FIG. 3, to exhaust ports 42 in end cap 38. Thus, large volumes of expended air are released from grinding bar 24 at a position well separated from maching site so that debris and cutting oil are not disturbed or blown about by the spent exhaust air of the pneumatic motor.

Figure 3:
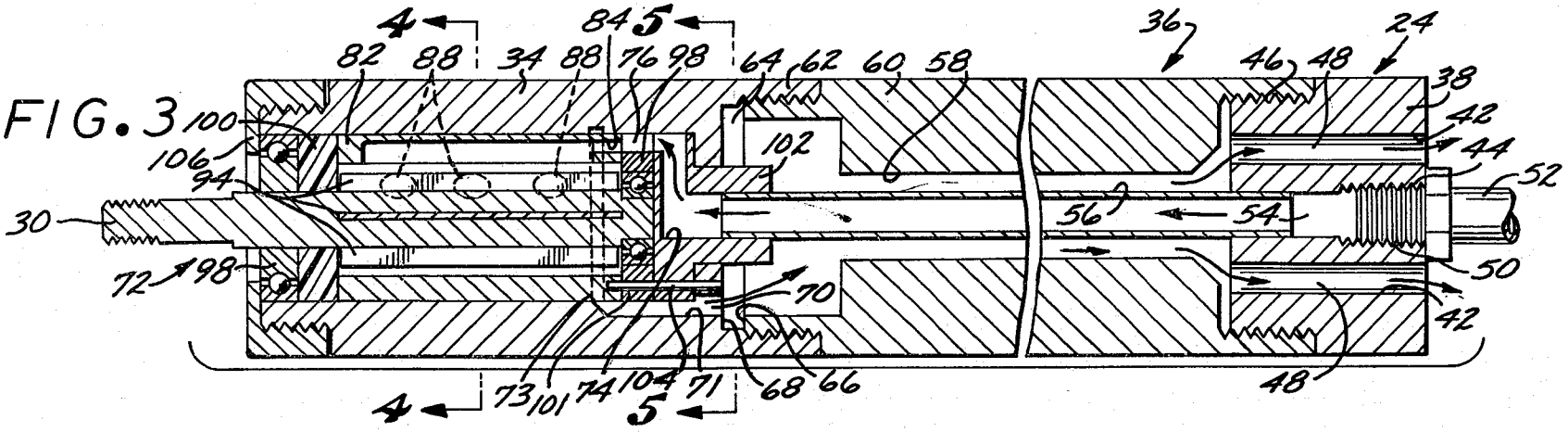
FIG. 3 is a sectional view in enlarged scale taken through lines 3—3 of FIG. 2.

The internal details of operation of grinding bar 24 can now be described and understood in connection with FIG. 3. FIG. 3 is a sectional view in enlarged scale taken through lines 3—3 of FIG. 2 along the longitudinal axis of grinding bar 24. Beginning with the right-hand end of grinding bar 24 in FIG. 3, end cap 38 is shown as connected to delivery tube 36 by means of conventional threading 46. Exhaust ports 42 are extended to form axial passages 48 through end cap 38, each axial passage 38 lying in a direction parallel to the longitudinal axis of grinding bar 24 and uniformly offset therefrom. Axial inlet port 44 is also shown as including conventional threading 50 into which is standardized fitting 52 has been threaded as illustrated in FIG. 3. Inlet port 44 extends into end cap 38 to form an axial passage 54 therethrough for communication and coupling to a pressure tube 56. Pressure tube 56, included as part delivery tube 36, slip fits into passage 54 and provides an axial tube through an internal bore 58 defined in a support housing 60 which forms the outside casing of delivery tube 36. Pressurized air from an external source is delivered through fitting 52, passage 54 and into pressure tube 56 in bore 58 to the opposing end of delivery tube 36.

Delivery tube 36 is best coupled to turbine housing 34 by means of conventional threading 62. Turbine housing 34 and support housing 60 are separated by a space 64 between end 66 of support housing 60 and a shoulder 68 of turbine housing 34. Space 64 is best shown in plan view in FIG. 5 which shows a sectional view through lines 5—5 of FIG. 3.

Figures 4, 5, 6, 7, 8:
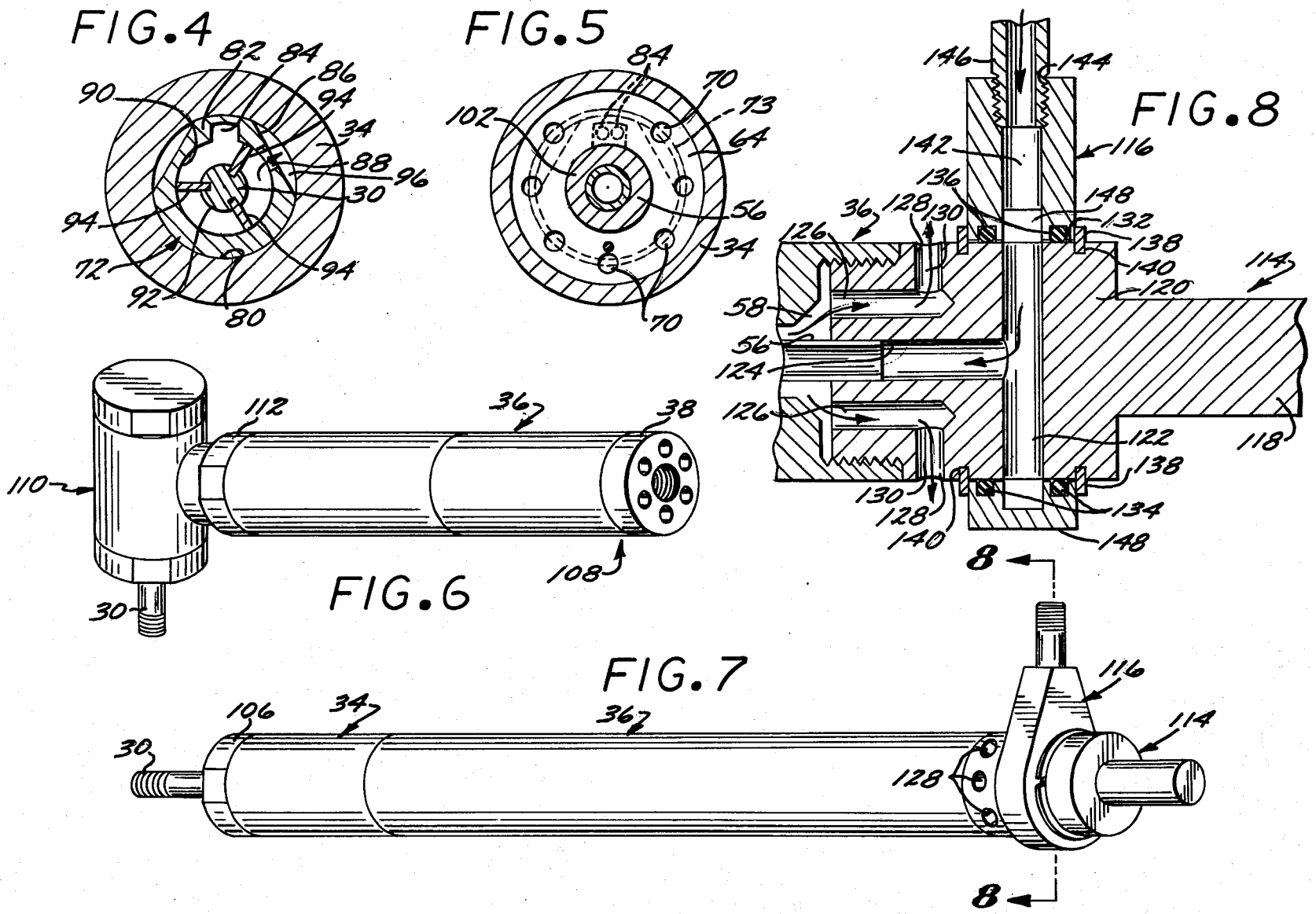
FIG. 4 is a sectional view taken through lines 4—4 of FIG. 3.
FIG. 5 is a sectional view taken through lines 5—5 of FIG. 3.
FIG. 6 is a perspective view of a second embodiment of the present invention wherein the turbine housing and delivery tube are oriented at right angles with respect to each other.
FIG. 7 is a perspective view of a third embodiment of the present invention wherein the delivery tube is combined with an inlet collar allowing the delivery tube to be rotated.
FIG. 8 is a sectional view in enlarged scale taken through lines 8—8 of FIG. 7.

Referring now to FIG. 5, space 64 is shown as including a plurality of metering ports 70 which are defined in turbine housing 34 and circumferentially disposed about the longitudinal axis of support housing 60. Thus, as will be described in greater detail below, ports 70 provide a means by which spent air from the pneumatic motor moves from turbine housing 34 into bore 58 of delivery tube 36 for eventual exhaust into the ambient environment through exhaust ports 42.

Referring now, again, to FIG. 3, the operation of the pneumatic motor, generally denoted by reference numeral 72, can better be described. As shown by the arrows, air enters motor 72 through an "L-shaped" inlet port 74 in a channel bushing 102 into which port 74 pressure tube 56 slip fits. Inlet port 74 directs the pressurized air upward, as shown in FIG. 3, into a inlet passage 76 in a rear bearing holder which then distributes the pressurized air across three motor inlet ports 78.

As better seen in sectional view in FIG. 4, taken through the lines 4—4 of FIG. 3, turbine housing 34 includes an axial cylindrical bore 80 into which pneumatic motor, generally denoted by reference character 72, is inserted. Pneumatic motor 72 is comprised of a motor housing in the form of a ovulate cylindrical casing 82 with flattened surface 86 through which motor outlet ports 88 are defined. Pressurized air from inlet passage 76 enters delivery slot 84 defined in the ovulate portion of casing 82 and is distributed into an internal turbine bore 90 of motor 72. A rotary turbine 92 is axially disposed within turbine bore 90 and includes three radial vanes 94 providing a sliding seal with bore 90. Vanes 94 divide turbine bore 90 into three chambers. As shown in FIG. 4, as one chamber fills with pressurized air it is driven in a counterclockwise sense, rotating until the leading vane 94 uncovers motor outlet ports 88 allowing a sudden decrease of pressure. Pressurized air exhausted through outlet port 88 is communicated through an exhaust passage 96, a portion of which is shown in FIG. 3, which passage 96 ultimately communicates with each of metering ports 70 communicating with space 64 as described above in connection with FIG. 5. Ports 70 are defined by a plurality of cylindrical exhaust bores 71 defined in turbine housing 34, each bare 71 having a longitudinal axis parallel to the longitudinal axis of turbine housing 34. Bores 71 extend far enough into turbine housing 34 to communicate with space 96 defined between bore 80 of turbine housing 34 and flat surface 86 of motor casing 82, as shown in FIG. 4, into which space 96 the exhaust air from motor 22 is delivered. The surface of bore 80 intersects the surface of bores 71 so that bores 71 are half-opened cylindrical passages everywhere except in the right hand portion of turbine housing 34 as shown in FIG. 3 where the bores 71 form circular ports 70 shown in FIG. 5. Each of the plurality of exhaust bores 71 are communicated by an annular ring-shaped passage 73 defined in bore 80 of turbine housing 34. As shown in FIG. 5, no exhaust bore 71 is formed in turbine housing 34 where delivery slots 84 in casing 82 are disposed. Passage 73 communicates with bores 71 at a point to the left of slots 84 as depicted in FIG. 3.

Returning again to FIG. 3, drive shaft 30, from which vanes 94 radially extend, is shown as journaled at each end within motor casing 82 by conventional ball bearings 98. The ends of motor casing 82 are pneumatically sealed by means of end plate 100 on the left end and by means of a rear bearing holder 101 which includes inlet passage 76 at the right end of motor casing 82 as shown in FIG. 3. Bearing holder 101 is forced against channel bushing 102, which in turn bears against the bottom portion of turbine housing 34.

Turbine housing 34 includes an end cap 106 screwed to the end of turbine housing 34 to securely retain bearings 98 and motor 72 within turbine housing 34. Bushing and rear bearing holder 101 on the right hand side of FIG. 3 must be aligned with delivery slots 84 formed in casing 82 in addition to having motor casing 82 fixed or stabilized within turbine housing 34. As shown in FIG. 5, an alignment pin 104 is provided which extends from motor casing 82 at one end through channel bushing 102 and into turbine housing 34 at its other end. Although shown in the lower portion of motor casin 82 for clarity in FIGS. 3 and 5, alignment pin 104 may be placed near and offset from inlet passage 76 in the ovulate portion of casing 82, thereby insuring the stability and alignment of motor 72 within turbine housing 34.

Therefore, different operating speeds can be obtained by inserting differently designed pneumatic motors 72 in turbine housing 34. Turbine housing 34 and motor 72 together with end cap 106 may alternatively form a unit which can then be coupled or uncoupled to delivery tube 36 as desired. Different motors can thus be inserted or coupled to delivery tube 36 as desired for each application at hand by a quick connect screw type fitting.

As described above, delivery tube 36 and turbine casing 34, together with motor 72, may assume a variety of angular orientations with respect to each other to enhance the adaptability of grinding bar 24. For example, referring to FIG. 6, a second embodiment is shown wherein the grinding bar, generally denoted by reference character 108, is shown as including a delivery tube, generally by reference character 36, which tube is coupled at right angles to a turbine housing, generally denoted by reference character 110. Instead of coupling through the end of turbine housing 110 as is the case of turbine housing 34 in the embodiment of FIG. 3, delivery tube 36 is coupled through the side of turbine housing 110 by means of a screw fitting 112 provided for that purpose. The details of fitting 112 are not shown, but can be deduced using design principles well known in the art. For example, the inlet passage coupled to the pneumatic motor included within turbine housing 110 of FIG. 6 could be extended through the side wall of turbine housing 110 at its mid-axial length as shown in FIG. 6 and then extended at right angles therefrom to screw type fitting 112. Fitting 112 would then include a metering plate similar to plate 64 of the embodiment of FIGS. 3–5.

A third embodiment of the present invention is illustrated in FIG. 7 wherein delivery tube 36 and turbine housing 34 of the embodiment of FIGS. 2–5 are modified so as to be coupled to a rotating end cap 114 held within an inlet collar 116. The details of rotating end cap 114 and inlet collar 116 are better understood in connection with FIG. 8 which is a sectional view in enlarged scale taken through lines 8—8 of FIG. 7.

Rotating end cap 114 includes a solid stem 118 integrally formed with body 120. Body 120 has defined therein a diametric, transverse passage 122 communicating with an axial passage 124 also defined in body 120. As before, pressure tube 56 of delivery tube 36 slip fits into axial passage 124 of body 120 but loosely enough to allow body 120 to rotate with respect to pressure tube 56. Body 120 also has defined therein a plurality of circumferential exhaust passages 126 which communicate with internal bore 58 of delivery tube 36, and which communicate with corresponding exhaust ports 128. Exhaust passages 126 are axially defined passages offset from the longitudinal axis of rotating end cap 114, which passages communicate with corresponding transverse passages 130, which in turn terminate in exhaust ports 128. Spent air from pneumatic motor 72 communicates through internal bore 58 of delivery tube 36 to exhaust passages 126 and thence ultimately to the ambient environment through exhaust ports 128.

Rotating end cap 114 is disposed through a corresponding axial bore 132 defined in inlet collar 116. End cap 114 rotates with respect to inlet collar 116 and is pneumatically sealed by means of a pair of O-rings 134 laid in annular O-ring grooves 136 defined in inlet collar 116. Rotating cap 114 is longitudinally retained to inlet collar 116 by means of a pair of snap rings 38 disposed in annular snap ring grooves 140. Snap rings 38 extend from snap ring grooves 140 to engage the side of inlet collar 116.

Inlet collar 116 has an inlet passage 142 defined in a stem portion which passage 142 terminates in an outlet port 144 into which a standard nipple fitting 146 is shown disposed. At its opposing end inlet passage 142 terminates in a ring-shaped passage 148 which communicates with the openings of transverse passage 122 defined in body 120. Thus, as end cap 114 rotates, the two end openings of transverse passage 122 are always in free communication with the angular ring-shaped passage 148 of inlet collar 116. Ring-shaped passage 148 forms an open, collar-shaped passage around end cap 114 so that pressurized air is supplied through inlet collar 116 into rotating end cap 114 without any impediment to the free flow of air into end cap 114 dependant on their relative angular orientation.

Although the present invention has been described in context of a particularly illustrated embodiment, it must be understood that many modifications and alterations may be made by those having ordinary skill in the art without departing from the spirit and scope of the present invention. For example, although delivery tube 36 has been shown either in a straight configuration as shown in FIG. 2, or in a right angle configuration as shown in FIG. 6, it is clearly contemplated within the present invention that delivery tube 36 may be angled along its length or curved to an arbitrary degree to provide any orientation of drive shaft 30 with respect to workpiece 26 as desired. For example, it is entirely within the scope of the present invention that an adjustable joint could be included as part of delivery tube 36 whereby an arbitrary bend in delivery tube 36 could be effected and fixed. Similarly, although turbine casing 34 of the embodiment of FIG. 2 has been shown as being coupled to delivery tube 36 in the embodiment of FIG. 7, it is expressly contemplated that turbine casing 110 with end fitting 112 could also be fitted to delivery tube 36 of the embodiment of FIG. 7 with equal ease and operability. Thus, the right angled bend of the embodiment of FIG. 6 could be used in combination with the rotating end cap 114 of the embodiment of FIG. 7.

Therefore, what has been described is a universal, pneumatically driven machine tool which can be easily adapted and used in combination with a conventional, quick-change tool holder in standard lathes and milling machines without the limitations and restrictions of custom designed, pneumatic grinding machinery typified by the prior art. By virtue of the interchangeability of the various components of the present invention, differing speed and power rated pneumatic motors can be combined with various types of delivery tubes to provide a large combinational variety of grinding bars for virtually any application.

Therefore, the above embodiments have been described only for the purposes of clarification and example and should not be taken as limiting the scope of the invention as set forth in the following claims.

We claim:

1. An improvement in a pneumatic drive for a tool comprising:

a turbine housing;

a pneumatic motor included within said turbine housing including a drive shaft extending from said pneumatic motor for engagement with said tool;

a rigid delivery tube connected on one end to said turbine housing for supporting said turbine housing in a predetermined orientation and position and for delivering pressurized air to said pneumatic motor; and mounting means for positioning and orienting said rigid delivery tube, said mounting means being connected to an opposing end of said rigid delivery tube, whereby said tool may be pneumatically driven in an arbitrary position and orientation by appropriate selection of the shape and length of said delivery tube thereby allowing said pneumatically driven tool to be easily adapted for use with standardized production machinery to which said mounting means is coupled.

2. The improvement of claim 1 wherein said pneumatic drive is used in combination with a quick-change tool holder and wherein said delivery tube is arranged and configured at its end distal from said turbine housing for connection with said quick-change tool holder, whereby said pneumatic drive is as quickly interchangeable with said quick-change tool holder as a standardized tool.

3. The improvement of claim 1 wherein said delivery tube is interchangeable with a plurality of pneumatic motors which are included within a corresponding turbine housing connected to said delivery tube, wherein each one of said plurality of pneumatic motors is characterized by a different operating speed.

4. The improvement of claim 1 or 3 wherein said delivery tube is a selected one of a plurality of delivery tubes each having a differing length and shape and wherein said position and angular orientation of said tool is determined by said shape and length of said related delivery tube.

5. The improvement of claim 1 further comprising a rotating end cap and inlet collar, said inlet collar having a passage defined therein for said pressurized air, said passage in said inlet collar communicating with a passage defined in said rotating end cap, said rotating end cap connected to the end of said delivery tube distal from said pneumatic motor, said rotating end cap communicating with a passage defined in said delivery tube to deliver said pressurized air to said pneumatic motor, said rotating end cap being disposed in a corresponding bore defined in said inlet collar and pneumatically sealed against said bore of said inlet collar by sealing means disposed between said bore in said inlet collar and said rotating end cap, whereby said delivery tube may be rotated with respect to said inlet collar and said inlet collar fixed with respect to said tool to allow rotational change of orientation of said delivery tube, and thus said turbine housing and tool.

6. An improvement in a pneumatic drive for use in combination with a quick-change tool holder comprising:

a turbine housing including a pneumatic motor having a driveshaft extending from said pneumatic motor and turbine housing;

a delivery tube including a rigid support housing connected to said turbine housing and including an air pressure delivery tube within said support housing connected to said pneumatic motor for delivering pressurized air to said pneumatic motor, said delivery tube further including an internal bore defined within said support tube communicating with said pneumatic motor to carry exhaust air from said pneumatic motor, wherein at least a portion of said support tube is arranged and configured for coupling to said quick-change tool holder; and an end cap connected to said support tube and including an axial inlet port and passage communicating with said air pressure delivery tube disposed within said support tube, said end cap further including a plurality of offset passages defined therein and including outlet ports, said end cap offset passages communicating with said internal bore defined in said support tube and used for exhausting air from said internal bore of said support tube, whereby a tool may be driven by said improved pneumatic drive and used in combination with quick-change tool holders as a universal machine tool.

7. The improvement to claim 6 wherein said delivery tube is selected from a plurality of delivery tubes having a differing length and shape and wherein the position and angular orientation of said tool is determined by said shape and length of said related delivery tube.

8. The improvement of claim 6 wherein said delivery tube is selected from a plurality of delivery tubes each having a differing shape.

9. The improvement of claim 6 wherein said delivery tube is selected from a plurality of delivery tubes each having a differing length.

10. The improvement of claim 6 wherein said pneumatic motor included within said turbine housing is selected from a plurality of pneumatic motors included within corresponding turbine housings wherein each pneumatic motor of said plurality has a different operating speed.

11. The improvement of claim 6 wherein said end cap is a rotating end cap and further includes an inlet collar having an axial bore defined therethrough, said rotating end cap being disposed through said axial bore and sealed therewith by a means for providing a pneumatic seal between said inlet collar and rotating end cap, said rotating end cap being connected to said support housing of said delivery tube and including said axial bore defined in said rotating end cap communicating with said air pressure delivery tube disposed within said support housing, said axial bore within said rotating end cap also communicating with a transverse passage radially defined within said end cap, said transverse passage communicating within an annular passage defined in said inlet collar, said pressurized air being delivered to said annular passage within said inlet collar through said rotating end cap to said air pressure delivery tube within said support housing, said rotating end cap also including said offset passages defined therein communicating with said internal bore within said support housing at one end of said offset passage and communicating with the ambient at the opposing end of said offset passage through said outlet ports to provide flow of exhaust air from said pneumatic motor through said internal bore of said support housing to the ambient, whereby said support housing may be rotated with said end cap with respect to said inlet collar, said inlet collar being arranged and configured for coupling to said quick-change tool holder.

* * * * *